United States Patent [19]

Misonoo

[11] 3,972,217

[45] Aug. 3, 1976

[54] DEEP DRAWING OF CUP-SHAPED ARTICLE FOR EASY REMOVAL FROM PUNCH

[75] Inventor: Kazunaga Misonoo, Kudamatsu, Japan

[73] Assignee: Yoshizaki Kozo, Tokyo, Japan

[22] Filed: Feb. 3, 1975

[21] Appl. No.: 546,782

[30] Foreign Application Priority Data

Mar. 22, 1974 Japan ..... 49/31537

[52] U.S. Cl. ..... 72/344; 72/349

[51] Int. Cl.[2] ..... B21D 45/00

[58] Field of Search ..... 72/344, 345, 347, 349

[56] References Cited

UNITED STATES PATENTS

| | | | |
|---|---|---|---|
| 2,011,907 | 8/1935 | Peters | 72/349 |
| 2,168,300 | 8/1939 | Lemming | 72/344 |
| 2,412,813 | 12/1946 | Keller | 72/349 |

*Primary Examiner*—Lowell A. Larson

*Attorney, Agent, or Firm*—Wenderoth, Lind & Ponack

[57] ABSTRACT

A method and apparatus for deep drawing a cup-shaped article in which a blank is placed on a punch and the punch is passed through a series of deep drawing dies, so that the force required to strip the drawn cup-shaped article from the punch is substantially less than in a conventional method. After the deep drawing is completed, the cup-shaped article is slightly drawn to the final desired dimensions by a drawing step in which the wall thickness of the article is reduced no more than 10%. This is carried out by a slight drawing die spaced from the last of the series of deep drawing dies, preferably a distance at least half the height dimension of the finished deep drawn cup-shaped article.

4 Claims, 5 Drawing Figures

DEEP DRAWING OF CUP-SHAPED ARTICLE FOR EASY REMOVAL FROM PUNCH

This invention relates to a method and apparatus for production of a cup shaped article with a bottom and a side wall and which is formed by deep drawing in such a way that the thus formed cup-shaped article can be easily stripped from a punch.

BACKGROUND OF THE INVENTION AND PRIOR ART

In the production of a cup-shaped article made of tin plate, aluminum or other material by deep drawing, a blank is formed into a shallow cup-shaped article, and then the said cup shaped article is drawn into a deep cup-shaped article by stretching the wall. At this time the distribution of the wall thickness along the length is not uniform.

The force to remove or strip the thus formed cup-shaped article from a punch varies according to the amount of reduction of the wall thickness, the forming speed, the distribution of the wall thickness, the height of the cup-shaped article and so on. The said force becomes large when the cup-shaped article is formed of steel plate.

The usual method of stripping the cup-shaped article by using a knock out ring or a hook to hold the open end of the cup-shaped article while the punch is withdrawn often causes a deformation of the wall at the open end part, as shown in FIG. 2. The less the thickness of the wall, the more likely this is to occur. The wall thickness of a cup-shaped article made of steel is less than one of aluminium, and therefore it is even more difficult to strip a cup-shaped steel article from the punch by using the knock out ring only.

To overcome this problem, there has been developed a method using an internal knock out pin provided inside of the punch in order to drive the bottom of the cup-shaped article away from the end of the punch, as disclosed, for example, in U.S. Pat. Nos. 3,270,544 and 3,390,565. However, the mechanism for forming the cup-shaped article which includes such a knock-out pin is complex.

Moreover, the forming speed is limited by the internal knock out pin which moves faster than the punch and by the shock on the article accompanying the action of the pin. Another disadvantage of the internal knock out pin is that the shape of the bottom of the cup shaped article is limited due to the presence of the internal knock out pin which moves in and out of the end of the punch.

Another common practice has been to taper the punch used to form cup-shaped articles so that it has a smaller diameter at the punch end in order to be able to easily strip the formed cup from the punch. However, cans for beer or the like beverages are necked in and flanged at the open end after the cup-shaped can is formed, so that it is necessary for these cans to have a thicker wall at the top or open end so as to be able to withstand such deformation. Therefore it is almost impossible, in making a punch to form these cans, to taper the punch to make it easy to strip the formed cup-shaped can therefrom.

The less the wall thickness of a can, the more economical it is to make. However, the top end part of the wall must have a minimum thickness in order to withstand the working thereof during the neck-in and flanging operation. The diameter of the punch corresponding to the top end part of the can must therefore be smaller than the remainder of the punch if the lower wall of the finished cup has a smaller thickness than the top end part of the wall. This makes stripping the cup-shaped article from the punch even more difficult.

OBJECTS AND SUMMARY OF THE INVENTION

It is an object of the present invention to provide a method and apparatus for drawing a cup-shaped article so that it can be easily stripped from a punch without any damage to or deformation of the top end part of the said article.

These objects are achieved by a drawing method in which the cup-shaped article is drawn from a thickness slightly greater than the desired thickness to the final desired thickness by a small drawing, i.e. less than 10% reduction, so that the residual stress produced during the last draw is reduced and the contact stress between the cup-shaped article and the punch is reduced.

The force required to strip the cup-shaped article from the punch corresponds to the frictional force which occurs between the punch and the cup-shaped article when they are moved relative to each other. Factors affecting the frictional force between the inside of the cup-shaped article and the punch are the thermal compressive stress caused when the cup-shaped article contracts when the heat produced by the drawing process is removed (generally soluble oil is sprayed on the cup-shaped article to cool it and to lubricate the dies), the contact pressure caused by elastic recovery of the punch after drawing, and the contact pressure between the cup-shaped article and the punch caused by the thicker open end part of the cup-shaped article passing over the larger diameter part of the punch. In addition the circumferential residual stress caused by the drawing increases the contact pressure between the cup-shaped article and the punch.

Therefore by reducing this residual stress, the contact pressure between the cup-shaped article and the punch can be reduced so that the cup-shaped article will slide more easily on the outside of the punch and the cup-shaped article can be stripped from the punch easily compared with the situation in which the residual stress is large.

By adopting this method, there is no necessity to provide a complex internal knock out punch mechanism. The cup-shaped article can be stripped easily by means of the conventional hook or knock out ring without damage to the cup-shaped article.

BRIEF DESCRIPTION OF THE DRAWING

The invention will now be described in greater detail with reference to the accompanying drawings, in which:

Referring to FIG. 1, the cup-shaped article 10 is composed of a side wall 11 and a bottom 12. The wall is divided into a wall part 11*a* having a thickness *tw* and a top end part 11*b* having a thickness *tf*, and the thickness *tf* of the top end part is greater than the thickness *tw* of the wall part in order to prevent the buckling of the top end part during a neck-in and flanging operation. Therefore, the diameter of the portion of a punch 20 corresponding to the top end part of the cup is slightly less than that corresponding to the wall part.

FIG. 3 shows an arrangement of the punch 20 and drawing dies 30*a*, 30*b* and 30*c*, a domer 40 and a knock out ring 35 arranged to carry out a conventional drawing operation.

The wall 11 of the cup shaped article 10 is drawn so as to reduce the wall thickness 30% at each die 30*a*, 30*b* and 30*c*.

Figure 2:
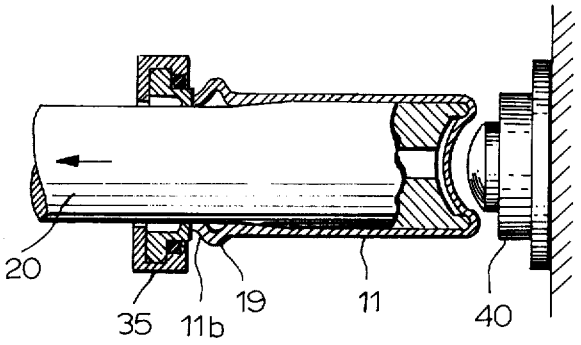
(PRIOR ART) FIG. 2
FIG. 2 is a view for explaining the deformation at the top end of a cup caused by stripping a cup-shaped article according to the prior art.
Figure 3:
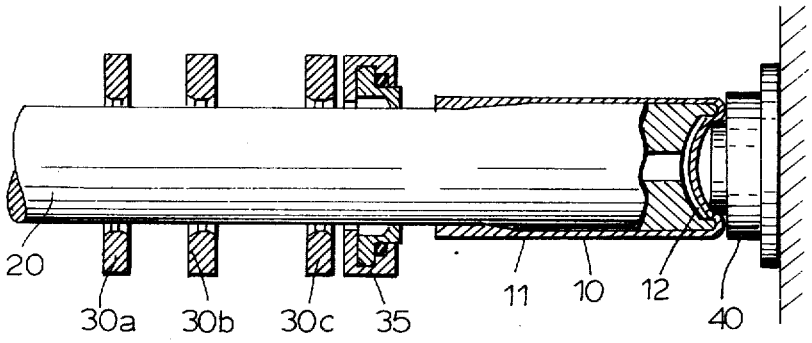
(PRIOR ART) FIG. 3
FIG. 3 is a sectional view of a punch and die arrangement using a conventional knock out ring.
Figure 4:
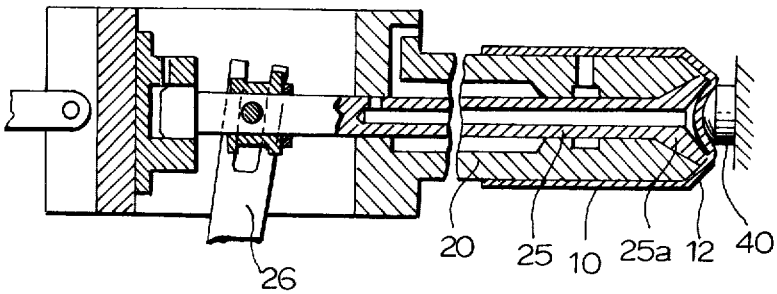
(PRIOR ART) FIG. 4
FIG. 4 is a sectional view of an internal knock out pin mechanism.

FIG. 4 shows the complex mechanism of an internal knockout pin 25 provided in the punch 20 in order to avoid a deformation 19 of the wall 11*b* on the cup-shaped article 10, as shown in FIG. 2, when the article is stripped simply by the knock out ring 35. This internal knock out pin 25 on the inside of the punch 20 is moved a certain distance relative to the punch 20 by a driving mechanism 26 and pushes the bottom 12 of the cup shaped article 10 away from the punch 20 in order to remove it therefrom. The motion of this complex mechanism causes certain limits on the forming speed of this mechanism.

Further, the free end 25*a* of the internal knock out pin 25 and the domer 40 combine to form the bottom 12 of the cup-shaped article 10, so there are obviously limits to the design of the bottom shape.

Figure 5:
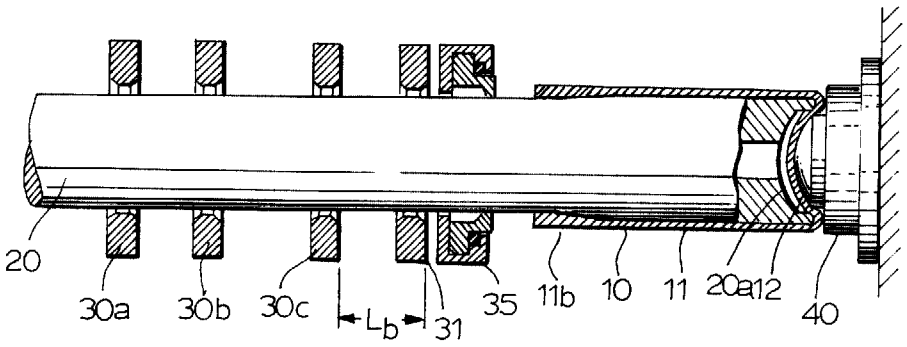
FIG. 5 is a sectional view of a punch and die arrangement according to the present invention.

FIG. 5 shows an example of one arrangement of the apparatus for carrying out the method of the invention, comprising a punch 20, dies 30*a*, 30*b* and 30*c*, a slight drawing die 31 that provides only a small drawing, a knock out ring 35 and a domer 40.

The amount of reduction of wall thickness in each die 30*a*, 30*b*, and 30*c* is more than 30%, and the amount in die 31 is less than 10%.

In this method, even where the distance L*b* between the die 30*c* and the light drawing die 31 is such that the cup-shaped article is acted on by both dies at the same time, the wall 11 of a cup 10 is not broken because the amount of drawing in the die 31 is small, i.e. less than 10%.

The net tension force in the wall 11 of the cup 10 between the end 20*a* of the punch 20 and the slight drawing die 31 is relatively small, but the force necessary for drawing more than 30% in die 30*c* adds to the tension force, so the tension force at the slight drawing die becomes larger than if the slight drawing die 31 were by itself. Therefore, the circumferential residual stress is greater than if the die 31 were used by itself, and thus the object of the present invention, namely to substantially reduce the residual stress and the force required to remove the cup-shaped article, is not completely achieved.

Figure 1:
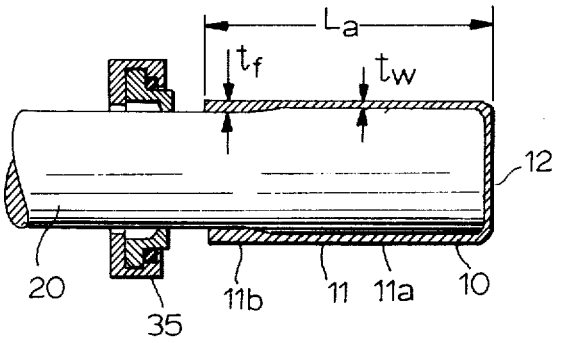
(PRIOR ART) FIG. 1
FIG. 1 is a sectional view showing the shape of a cup shaped article and a punch.

Therefore, it is preferred that the distance L*b* be greater than the height L*a*, as shown in FIG. 1, of the finished cup-shaped article. However, very good results are also obtained in the reduction of the force necessary to remove the cup-shaped article 10 when L*b* is greater than one-half of L*a*. This is very beneficial in designing the apparatus so that it occupies a minimum amount of space.

A cup 10 shown in FIG. 1 of tin plate and having dimensions *tw*=0.11 m/m, *tf*=0.18 m/m and an inner diameter 65.40 m/m was drawn from a deep drawn cup having an inner diameter of 65.60 m/m and was then removed from the punch 20.

For the method according to the invention, the distance L*b* in FIG. 5 was 65 mm and the height of the finished cup-shaped article was 130 mm. The value of the stripping force required to strip the cup-shaped article was measured by a strain gauge on the punch 20. The results of the usual method compared to the method of this invention are shown in the following table.

TABLE

| Method | Item: Test Run | Reduction at the 3rd. die (die 30c) | Reduction at the slight drawing die (die 31) | Stripping force | Rate of the deformation at the top end of the cup (19 in FIG. 2) |
|---|---|---|---|---|---|
| Usual method | A | 42 % | — | 413 kg | 90 % |
| | B | 35 | — | 407 | 85 |
| Method according to this invention | A | 35 % | 10.0 % | 235 kg | 4 % |
| | B | 37 | 8.5 | 200 | 1 |
| | C | 39 | 5.0 | 206 | 1 |
| | D | 40 | 2.7 | 240 | 5 |

From the above data it can be seen that by adding the slight drawing, the force necessary for stripping the cup-shaped article 10 can be reduced to about a half that of the usual method, and the cup chaped article can be stripped easily without the need for an internal knock out pin 25 inside of the punch 20. Moreover, the amount of abrasion of the punch 20 is reduced as compared with the usual method. The reduction of force is even greater where the slight drawing die is spaced from the last regular drawing die a distance more than half the height of the finished cup-shaped article.

What is claimed is:

1. A method of deep drawing a cup-shaped article in which a blank is placed on a punch and the punch is passed through a series of deep drawing dies, the method being for carrying out the drawing so that the force required to strip the drawn cup-shaped article from the punch is substantially less than in a conventional method, said method comprising, after the deep drawing is completed, slightly drawing the cup-shaped article to the final desired dimensions by a drawing step in which the wall thickness of the article is reduced no more than 10%.

2. An apparatus for carrying out a deep drawing of a cup-shaped article in such a way that the force required to strip the article from the apparatus is substantially less than in a conventional method, said apparatus comprising a punch for inserting into the cup-shaped blank from which the final article is to be drawn, a series of aligned deep drawing dies through which said punch is movable and each of which has a size for reducing the wall thickness of the blank by at least 30%, and a slight drawing die spaced from the last of the series of deep drawing dies and which has a size for drawing the blank to the final dimensions by reducing the wall thickness of the blank by less than 10%.

3. An apparatus as claimed in claim 2 in which said slight drawing die is spaced from the last deep drawing die a distance at least half the height dimension of the finished deep drawn cup-shaped article.

4. An apparatus as claimed in claim 2 in which said slight drawing die is spaced from the last deep drawing die a distance greater than the height dimension of the finished deep drawn cup-shaped article.

* * * * *